United States Patent [19]

Herzig

[11] 4,252,257

[45] Feb. 24, 1981

[54] AUTOMATIC CLOSURE FOR CONTAINERS HAVING A PINCH-OFF FOLD

[76] Inventor: Albert M. Herzig, 700 N. Rexford Dr., Beverly Hills, Calif. 90212

[21] Appl. No.: 949,900

[22] Filed: Oct. 10, 1978

Related U.S. Application Data

[63] Continuation-in-part of Ser. No. 482,337, Jun. 24, 1974, abandoned, which is a continuation-in-part of Ser. No. 176,874, Sep. 1, 1971, abandoned, which is a continuation-in-part of Ser. No. 842,108, Jul. 16, 1969, abandoned.

[51] Int. Cl.[3] ..... B65D 5/72

[52] U.S. Cl. ..... 222/213; 222/491

[58] Field of Search ..... 222/107, 207–212, 222/213, 215, 491, 494, 541; 229/7, 17 R, 22

[56] References Cited

U.S. PATENT DOCUMENTS

| | | | |
|---|---|---|---|
| 2,143,661 | 1/1939 | Schrader | 222/207 |
| 2,663,461 | 12/1953 | Brown | 222/107 |
| 2,815,150 | 12/1957 | Herzig | 222/491 X |
| 3,009,498 | 11/1961 | Fohr | 222/107 X |
| 3,815,794 | 6/1974 | Carlisle | 222/491 |
| 3,878,977 | 4/1975 | Carlisle | 222/491 |

*Primary Examiner*—Stanley H. Tollberg
*Assistant Examiner*—Fred A. Silverberg
*Attorney, Agent, or Firm*—Herzig & Walsh Incorporated

[57] ABSTRACT

An automatic closure for collapsible tubes, squeeze bottles, and the like containers of the type formed from resilient plastic material. The container typically is tube-like, provided with a tapered or frusto-conical neck portion terminating in a flattened mouth defining end lips forming an openable closure. Pressure applied to the body of the container remote from the lips to forms a transverse pinch-off across the end portions wherein the lips are deflected or bent along a line of curvature to one side or the other and at an angle to the axis of the container, and wherein the lips are also bowed, having a curved contour. Such pinch-off forms a closure across the neck portion. The pinch-off opens in response to pressure on the walls of the container proximate thereto in a manner to relive the pinch-off and permit the fluid contents to flow. Specifically, the pinch-off is in the following form: the end lips of the neck have a bowed contour about the lengthwise dimension. The neck is deflected or bent laterally at an angle. The pinch-off is at the line of deflection of the bowed end lips. Along this line (pinch-off) the lips are held together in sealing relationship but they will respond to open and release fluid upon exertion of pressure at a predetermined key area adjacent to the pinch-off line.

11 Claims, 7 Drawing Figures

FIG.1
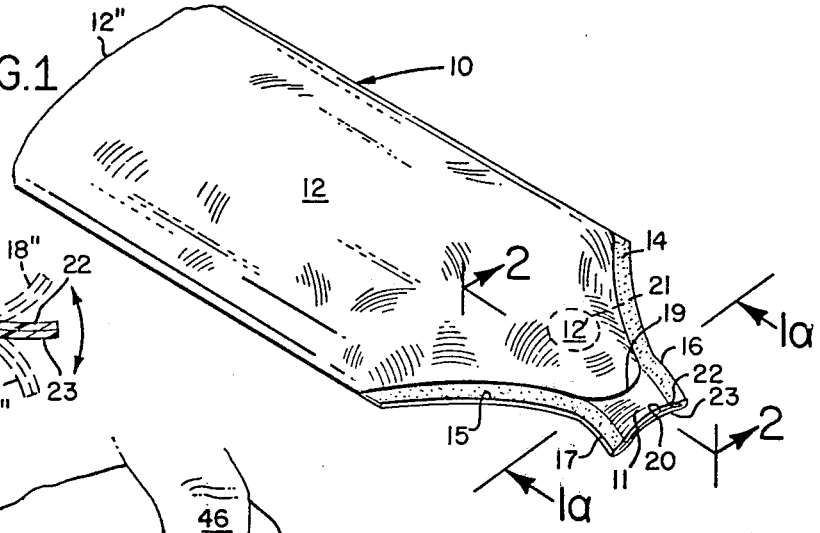
FIG.2a
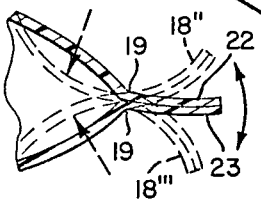
FIG.2b
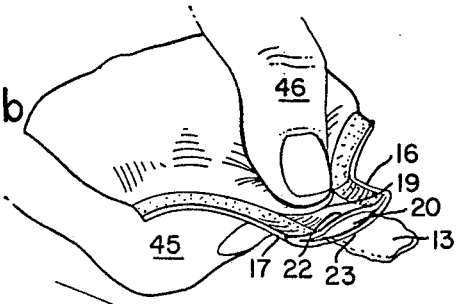
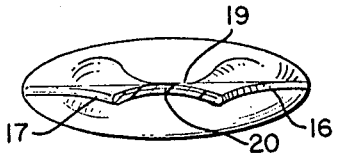
FIG.1a
FIG.3
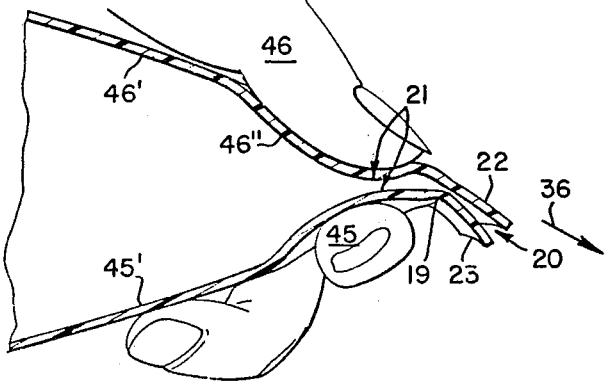
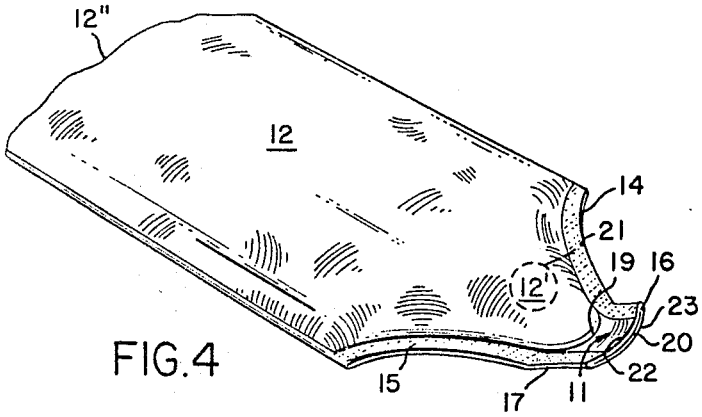
FIG.4
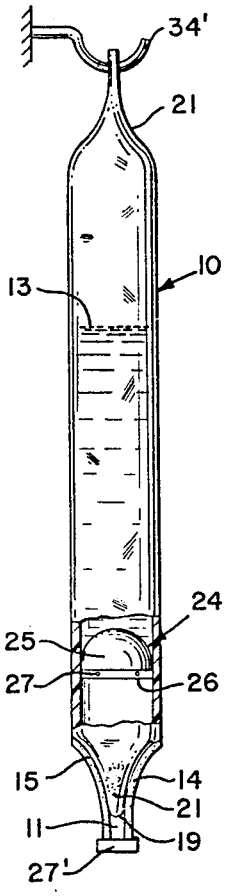
FIG.5

AUTOMATIC CLOSURE FOR CONTAINERS HAVING A PINCH-OFF FOLD

This application is a continuation-in-part of Ser. No. 482,337 filed 6/24/74 now abandoned.

This application is also a continuation-in-part of Ser. No. 176,874, filed Sept. 1, 1971, now abandoned entitled "Method of Fabricating Automatic Closure for Containers", which is a continuation-in-part of Ser. No. 842,108, now abandoned filed July 16, 1969, entitled "Automatic Closure for Containers and Methods of Fabricating the Same".

BACKGROUND OF THE INVENTION

1. Field of the Invention

The field of the invention is that of flexible containers, particularly tubelike or tube type containers which have an automatic, openable closure at one end. The openable closure referred to is of a type operable in response to exertion of preferably manual pressure on the container. The closure otherwise remains closed and retains fluid within the container.

2. Background of the Invention

The herein invention is an improvement over the inventions of U.S. Pat. Nos. 2,753,091; 2,815,150; 3,315,849; 3,451,120; 3,469,478; 3,486,666; 3,610,477; and applications Ser. Nos. 176,874 now abandoned filed Sept. 1, 1971; and 387,470 filed Aug. 10, 1973 now U.S. Pat. No. 3,825,157. In the background patents and pending applications referred to, the container shown has a neck portion with an automatic closure at the end of it. Typically, the side edges or side portions of the neck part are flattened, joined, and heat sealed together. These prior automatic closures are each characterized by certain advantages from the standpoint of construction, capabilities, and usage. The herein invention is unique with respect to all of them in that the openable closure is formed in a novel way as described in detail hereinafter which is considered to be an improvement over all of the prior art patents and applications.

SUMMARY OF THE INVENTION

Research in the construction of containers having an automatic, openable closure as referred to in the foregoing led to the conception and discovery of a novel and unique construction whereby an openable closure could be formed in an even simpler, more effective and more economical manner. A preferred embodiment of this invention comprises a tubelike container made of flexible homogeneous or laminated materials of the nature of low density polyethylene, plasticized vinyl, flexible plastic packaging material, rubber, and the like, and having a tapered neck part. The mouth portion is flat, there being a pinch-off (transverse cramp, bend, crease or kink) formed in the area of the neck and mouth at least when the container is under some pressure and the flat mouth part of the container normally being flexed and curved or bowed at an angle to the container lengthwise axis or dimension. The kink, cramp, bend, or crease (hereinafter "pinch-off") in this condition forms a curved and tapered closure concentrating the stresses in the pinch-off at the pinch-off line of the tapered neck in a manner which holds the fluid releasably sealed in the container.

The container walls can be of any desired unifrom thickness or optionally, or varying thickness. The main body can be, say, 0.001", to conserve material, while the mouth portion and adjacent operative portions can be thickened to approximately 0.010", or otherwise reinforced as determined by circumstances of use and requirements. Resilient reinforcement means including greater wall thicknesses can therefore be incorporated in the pinch-off area and other areas as needed, by dip-coating, spraying or otherwise adding structure to ensure the desired formation of the pinch-off even between squeezes. The pinch-off configurations can be also or further permanently impressed in the container walls by straining them beyond their elastic limits.

However, upon application of suitable relatively slight manual pressure to certain areas of the container adjacent the pinch-off, the pinch-off is thereby relieved to permit discharge from the container; that is, in response to pressure, the bowed and bent or angled mouth tends to straighten out opening the closure and allowing the liquid to be discharged. Upon release of said pressure the flat end part reassumes the original angle at which the pinch-off again occurs, retaining the fluid in the container, preferably under such an amount of residual pressure as is needed to concentrate the stresses necessary to form and hold the pinch-off in the neck. Alternatively, the pinch-off may be preformed permanently by creasing or molding the mouth in the desired shape, as when filling with a suitably heated fluid under pressure; for example, its proposed contents or by presetting the same through forcing the parts beyond their elastic limits or memories.

It is mainly to be understood that the pinch-off is normally formed by the mere squeezing of the main body of the container remote from the lips thereof and exerts an ever stronger closing action corresponding to the squeeze-pressure, and that said closing action is normally relieved for opening by pressing or squeezing the container near the pinch-off in predetermined locations and directions as described herinafter. Further modifications and refinements are herein suggested to those skilled in this art and further refinements and modifications within the range of equivalents and alternatives.

The construction as described adapts itself either to discharge of metered quantities or to continuous flow of liquid from the container. To facilitate such discharge of desired metered or limited quantities of liquid, a further feature may be embodied in the container comprising a check-valving means. Thus, in a preferred form, a flexible member, or diaphragm, which may be dome-shaped, is placed in the container at a proximal position spaced from the mouth end. The dome is secured at spaced points around its periphery to the interior sidewalls of the container, to provide a form of check valve which allows liquid to pass in a direction towards the mouth of the container between the points of securement but which restrains backflow in the opposite direction. In this manner, measured squeezing pressure applied to the container between the valve and the mouth causes metered amounts of fluid to be discharged. This type of container may be suspended vertically, the body of fluid above the mouth thus providing a head of pressure needed to retain the pinch-off in closed condition unnecessary if the pinch-off configuration is molded or preformed on the container opening.

In the light of the foregoing, a primary object of the invention is to provide an improved openable closure for containers of the type described formed simply by way of a narrowed and flattened end part at the discharge end of the container, optionally preformed with a transverse pinch-off across the flattened end part spaced inwardly from the end.

Another object is to provide an openable closure as in the foregoing object wherein the end part of the container is generally tapered, and side edge portions are heat sealed or held together, and the container has a flattened mouth end portion beyond the tapered portion, all shaped to concentrate the stresses induced by internal fluid pressure on the contents of the container in a manner to cause the mouth end of the container to form or hold a pinched configuration.

Another object is to provide a container as in the foregoing objects which has means within the container constructed to act as a check valve spaced a predetermined distance from the openable closure at the end of the container whereby discharge pressure can be more readily applied to the contents adjacent the mouth—especially when the container is partially empty or when volume or quantity control is desired as determined by digital pressure near the neck and by the shape, size, and volume of the container near the neck.

Another object is to provide a container of upmost simplicity, economy and effectiveness for the intended purposes.

BRIEF DESCRIPTION OF THE DRAWINGS

Further objects and additional advantages of the invention will become apparent from the following detailed description and annexed drawings, wherein:

FIG. 1 is a perspective view of a container embodying a preferred form of this invention;

FIG. 1*a* is a sectional view taken along line 1*a*—1*a* of FIG. 1;

FIG. 2*a* is a partial sectional view more clearly showing the lateral flexing of the neck;

FIG. 2*b* is a partial perspective view illustrating discharge occasioned by digital pressure;

FIG. 3 is a sectional view on the line 2—2 of FIG. 1 showing the parts in operative positions resulting from digital pressure;

FIG. 4 is a perspective view from the reverse side of FIG. 1 more clearly showing the neck bowed in the opposite direction from FIG. 1;

FIG. 5 is a side view of a second preferred form of container embodying this invention;

DESCRIPTION OF THE PREFERRED EMBODIMENTS

A container 10 shaped to provide a flattened mouth 11 of smaller scope than that of the body 12 of the container and in such a configuration as to foster the formation of a pinch-off means including lateral flexure, deflective or bend, e.g. FIGS. 1, 1*a*, 2, 3 and 4, of the mouth 11 relative to the body 12 and bowing of the lips (e.g. FIGS. 1, 1*a*, and 4), effectively pinches off the flow of such fugitive liquids as bath oil 13 or other fluid packaged therein. This desired result follows even though the mouth 11 is not provided with any other seal or closure means. (Corresponding parts in the respective embodiments are designated by the same reference numerals.)

The quantum of pressure on the fluid within the container necessary to obtain this result need be only the head weight of the liquid 13 in the container if the container is long enough and the liquid is of proper viscosity. Thus, an approximately 0.3 meter Long tubular container of approximately 3 cm. diameter composed of and having walls approximately 25 millimeters thick of low density polyethylene and being half to three-quarters filled with bath oil has held without drippage when suspended upside down, see FIG. 5. In the instant example, the mouth was flattened and heat sealed along its edges 14 and 15 continuously with proximate end 12' of the container body, the latter along a taper on each corresponding side edge at an angle of approximately 45° on each side, defining a neck portion, thus intersecting and being continuous with the edges 16 and 17 of the mouth 11. Such side edges 14 and 15 respectively converge, but at and in defining the mouth 11 are preferably parallel or approximately so as indicated by numerals 16 and 17. It is also contemplated that the angled side edges 14 and 15 may be in the unflattened form of a frustum of a cone 12' of uniformly rounded cross-sections extending continuously as a neck between the cylindrical (or other) shape of the container body 12 and the flattened mouth 11.

But in any case when the container body is filled with liquid and squeezed, said proximate tapered or conical portion 12- begets a fullness which concentrates the stresses approximately at or near the projected or theoretical apex 19 thereof and in a manner to pinch off the flow in the mouth thereat. Simultaneously, the mouth deflects or bends laterally at an angle, e.g. FIG. 2, 3 or 4, to one side or the other. Also simultaneously, the deflected mouth affects a bow or curved contour therein as seen at its end 20 and in transverse cross-section (e.g. FIGS. 1, 1*a*, 2*b* and 4) induced by the stresses on the resultant fullness and bulging in the adjacent geometry of the container. More forceable squeezing serves only within practical elastic limits of the materials and in a practical manner to further effect said pinch-off and even more positively prevent the flow of the fluid from the container. The angle of the neck can be varied as desired, i.e. edges 14 and 15.

Squeezing the container at its end 12'' remote from the mouth 11, or in a more central part 12 of the body, tends to stress the pinch-off means 19 and provide greater closing pressure. If, however, while the container is being squeezed, pressure is applied manually at 12' as shown in FIG. 1, or orally, or otherwise, to deflect the container body wall inwardly, as shown in dotted outline in FIG. 2*a* for example, in the approximate area experimentally delineated at the circled area 21, FIG. 1 on the side of the body towards which the mouth 11 is deflected and on which the involute pinch-off is primarily formed, the pinch-off is relieved and the contents 13 are expelled between the lips 22 and 23 of the mouth 11.

A greater amount of squeeze pressure on the body 12 remote from the mouth 11 is required to open the mouth by forcing the same; i.e., forcing the pinch-off to creep towards the end 20 and depends upon the strength and thickness and the relative rigidity, flexibility, or elasticity of the container walls, as well as the distance between the pinch-off means 19 and the end 20 of the mmouth 11. If such squeeze pressure on the container body succeeds in forcing the pinch-off to the end 20, the contents are expressed with an equal and considerable force. But when pressure is applied at 21 as stated, the mouth 11 is opened readily, immediately, and with ease and in such force and volume as desired. These parameters are determined by pre-design, calculation and experiment and include the length, the width (whether wide or narrow) and the desired shape of the mouth 11—which can be thicker or thinner or can be tapered or otherwise shaped in any direction and in any form different from the sides or the edges 14 and 15—in addition to the factors elsewhere mentioned.

The mouth 11 can also be readily opened and the pinch-off relieved by flexing or bending the lips 22, 23 towards the opposite side of the container axis from their pinch-off position (see FIG. 3). The mouth can also be readily opened by pressing or flexing the lips 22, 23 in a direction to straighten or reverse the transverse curvature, bend, or bow thereof illustrated, for example, in FIGS. 1 or 4. If the container is pushed and axially and appropriately squeezed by a user into his mouth between and against his teeth, the container mouth will also readily open and the contents expelled for consumption.

As shown in FIG. 5, the container 10 can be provided with means such as an eyelet for hanging as on a hook 34'. Liquid 13 can move gravitationally past a check valve means 24. In the example shown, such means comprises a flexible dome or diaphragm 25 of, e.g. polyethylene, integral with a lower skirt portion 26 secured as by spot welding 27 at circumferentially spaced points to permit flow downwardly between said points and also between the dome and the adjacent wall of the container but to check upward flow when the container is squeezed in the area between the valve means 24 and the pinch-off means 19, particularly in the above-described critical position 21. A preferred resistance to upward flow of the liquid 13 is encountered and which is instead transmitted to the liquid at 21 so as to force it through the mouth 11 as the pinch-off means 19 is thereby selectively simultaneously and easily relieved as also previously described. Other check valve means will also serve.

Repeated squeezes thus squirts controllable amounts of fluid from the container as desired. Between squeezes the container below the valve 24 is replenished by flow from above and past said valve.

In the absence of the valve means 24, the force and volume of fluid squeezed from the container at each manipulation is dependent upon the weight of the fluid above the pinch-off means 19 and is further increased upon the deliberate "milking" or stroking of the container in the proximate (herein, lower) end, at the area 21, and in the mouth 11, or by merely squeezing the container as above noted at the place, e.g. 21, where the pinch-off is best relieved, but always centrally enough (in all embodiments) to permit flow therearound.

The upper end of the container of FIG. 5 can be open or openable for refilling.

An integral but removable tear strip 27' (FIG. 5) or the like removable cover is formed as by heat sealing and scoring across the mouth 11 at and outwardly of the end 20 thereof in any of the containers in a known manner to permit shipment and the like before use. With sufficient stiffness inherently embodied or otherwise supplied at the mouth area 11, a shrink wrap or the like can be used with the added advantage of sanitation. Additionally, as heretofore noted, suitably added strength in the mouth area at, and especially outwardly of, the pinch-off desirably promotes the pinch-off action even without otherwise needed residual fluid pressure within the container. Any such added strength or reinforcement is merely intended to set or encourage the desired curved and bowed configuration around the pinch-off to encourage its formation, not to prevent it.

By way of further example, another preferred embodiment of this invention is composed of approximately 2" wide "layflat" polyethylene (trademark "ALATHON") plastic tubing and having a uniform wall thickness of approximately 0.012". The mouth is approximately ½" in width between its parallel side edges. The mouth is approximately ½" long and the pinch-off forms as a curve at approximately ⅛" beyond the small end of the truncated cone defined by the side edges, that is to say, the pinch-off projects into the mouth area approximately ⅛".

The sides and more importantly the mouth are formed between flat dies holding them flush while heat sealing them together as illustrated and described in the above prior art patents.

For further example: the check valve hemisphere is spot welded at approximately ¾" intervals and comprises a low density polyethyline hemisphere continuous with a circumferential cylinder skirt approximately ⅝" extending downwardly (see FIG. 5) to provide the check valving action. The hemisphere is of approximately 0.025" low density polyethylene at the top and tapers in thickness to approximately the thickness of the walls of the container at its skirt portion.

The best pressure spot for easy opening the pinch-off has been found to be approximately ½" to ¾" upwardly from the bottom edge of the pinch-off on its most involuted side, but experimental location thereof is advantageous in many instances in the various possible embodiments wherein (FIG. 3) the opening fingers 46 and 45 need sometimes to be brought together to bring the opposite sides 45' and 46' into contact at 45" and 46" at approximately area 21.

In the last example above, an average squeeze at the area 21 on each side; i.e., between thumb and forefinger, delivers approximately ¼ teaspoonful of liquid bath oil (such as that provided by Plough, Inc.), with the flow continuing in a steady stream if held squeezed.

Other liquids satisfactorily held in one or another forms of the subject containers include water, shampoo, thixotropic and jelly-like fluids, other liquids, semi-fluids, and the like.

Greater dispensing forces and volumes can be obtained if the user will close his (or her) fist around the container and around the mouth end portion with the ends of the fingers also compressing the tapered end portion (including one of the areas proximate to the mouth and generally indicated at the area 21), of FIG. 3.

Handheld and smaller containers, as for a few ounces or for fractional ounces, are preferably sealed at their opposite end (corresponding to the top end in FIG. 5). The contents can easily be expelled by pressure on the whole container, again including an area such as that generally indicated at 21. Folding or rolling up of the container body can be resorted to when pressure is needed to relieve the pinch of the closure to expel the contents of a partially emptied container, or to "force" the pinch-off in containers with lips preferably shortened to permit such forcing and to be restored to the pinched off condition if a multiple use —as opposed to a single use—container is desired.

The mouth of container 10 can be curved or bent to either side as at 18" or 18''' (FIG. 2*a*) and can be opened with ease by manual pressure as applied digitally as indicated at 45 and 46 FIG. 2*b* respectively causing expelling of the contents as shown, e.g. by the arrow 36 (FIG. 3). Manipulation, function and structure in FIG. 3 is common to both embodiments.

In sum, it was discovered that squeeze pressure applied to a subject container at points which do not distort the normal geometry of the neck and mouth area tends to form a pinch-off and added pressure only furthers the effective flexing and closing action. Previously, this was considered an undesired result and means were used to avoid it. But dramatically lower pressure simultaneously applied to selected positions at the neck or mouth serve to open such closure with surprising ease.

The thrust of this discovery is, therefore, the formation of the pinch-off as described having capability as and for a closure means in and of itself. And if reinforcing means are to be added, their purpose and intent is to improve and enhance the pinch-off formation, not to prevent it.

It is thus a further purpose and intention to cause the otherwise pressurized container and closure to an open posture by means of a distinct and separately recognized manipulation. This is accomplished, for example, in FIG. 3 by simultaneous hand pressure and opening pressure by finger 46 and 45, opposite side and in FIG. 5 by the weight of the liquid and back pressure against the area 21 when squeezed, by any combination of such means and methods.

The foregoing disclosure is representative of preferred forms of the invention and is to be interpreted in an illustrative rather than a limiting sense, the invention to be accorded the full scope of the claims appended hereto. Thus, the location of the pressure point 12' may be varied depending upon the length of the mouth between its end 20 and the pinch-off 19. As these points approach one another, the pinch-off 19 can be forced passed the end 20 from pressure anywhere on the container. The pinch-off configuration and the end 20 of the mouth will restore themselves to their closed position upon release of pressure, and such restorative action can be modified as desired through the use of semi-rigid or even rigid polyethylene vinyl and analogous materials in the total container or only in the mouth or pinch-off areas or both.

What is claimed is:

1. In a resiliently flexible container for fluid having an outlet and an openable closure, the improvement comprising; the container having opposed, flexible resilient wall portions each having a tapered end portion, terminating in a flattened end lip portions extending therefrom and said end lip portions being juxtaposed against each other and defining therebetween a restricted slit outlet, the container having a pinch-off fold extending transversely across said flat end portions at said tapered end portion with the end lip portions normally bowed with respect to the lengthwise dimension and deflected or bent laterally at an angle thereby to one side, whereby the stresses at the pinch-off means are concentrated and the slit outlet is normally closed at the position of the pinch-off fold, the material of the container having the characteristic that upon application of external pressure to the container adjacent the pinch-off fold, the said contained fluid will tend to relieve the pinch-off fold causing the end portions to straighten out with the fluid passing outwardly between the juxtaposed portions.

2. A container as in claim 1, wherein said wall portions have side edges extending to the ends of said flat portions, means whereby said side edges are held in said bowed and laterally deflected face-to-face abutment outwardly of the pinch-off fold.

3. An article as in claim 1, including check valve means within the container constructed to allow free flow of fluid in a direction towards the outlet, but to restrict flow in a direction away from the outlet.

4. An article as in claim 3, wherein said check valve means comprises an active diaphragm member secured in the container at a position inwardly from the openable closure.

5. A resiliently flexible container as in claim 1, the end portions including reinforcing means to set and hold the pinch-off fold in normally closed posture.

6. A resiliently flexible container, as in claim 1, including means to hold the mouth in a flexed and bowed configuration outwardly of the pinch-off fold.

7. In a resiliently flexible container for fluid having an outlet and an openable closure, the improvement comprising: the container having opposed, flexible resilient wall portions having flattened end lip portions juxtaposed against each other defining therebetween a restricted slit outlet, the normal internal pressure of a contained fluid forming a pinch-off means extending transversely across said flat end portions with the end portions normally bowed with respect to the lengthwise dimension and deflected or bent laterally at an angle thereby to one side, whereby the stresses at the pinch-off means are concentrated and the slit outlet is normally closed at the position of the pinch-off means, the material of the container having the characteristic that upon application of external pressure to the container adjacent the pinch-off means, the said contained fluid will tend to relieve the pinch-off means causing the end portions to straighten out with the fluid passing outwardly between the juxtaposed portions, and including check valve means within the container constructed to allow free flow of fluid in a direction towards the outlet, but to restrict flow in a direction away from the outlet.

8. An article as in claim 7, wherein said check valve means comprises an active diaphragm member secured in the container at a position inwardly from the openable closure.

9. In a resiliently flexible container for fluid having an outlet and an openable closure, the improvement comprising: the container having opposed, flexible resilient wall portions having flattened end lip portions juxtaposed against each other defining therebetween a restricted slit outlet, the contained fluid normally being subjected to pressure, the internal pressure of the contained fluid forms a pinch-off means extending transversely across said flat end portion with the end portions normally bowed with respect to the lengthwise dimension and deflected or bent laterally at an angle thereby to one side, whereby the stresses at the pinch-off means are concentrated and the slit outlet is normally closed at the position of the pinch-off means, the material of the container having the characteristic that upon application of external pressure to the container adjacent the pinch-off means, the said contained fluid will tend to relieve the pinch-off means causing the end portions to straighten out with the fluid passing outwardly between the juxtaposed portions, and including the container having construction to allow free flow of fluid in a direction towards the outlet, but to restrict flow in a direction away from the outlet.

10. An article as in claim 9, wherein said construction includes check valve means comprises an active diaphragm member secured in the container at a position inwardly from the openable closure.

11. An article as in claim 9 wherein the fluid is a liquid type and the container is arranged for external force to pressurize the liquid.

* * * * *